United States Patent [19]

Kaga

[11] 4,161,314

[45] Jul. 17, 1979

[54] AMUSEMENT DEVICE WITH APERTURES AND TIMED BALL RELEASE

[75] Inventor: Takashi Kaga, Tokyo, Japan

[73] Assignee: Tomy Kogyo Co., Inc., Japan

[21] Appl. No.: 738,329

[22] Filed: Nov. 2, 1976

[30] Foreign Application Priority Data

May 26, 1976 [JP] Japan ..... 51/67981[U]

[51] Int. Cl.[2] ..... A63D 13/00; A63B 71/04

[52] U.S. Cl. ..... 273/121 R; 273/125 R

[58] Field of Search ..... 273/121 R, 121 A, 121 D, 273/124 R, 124 A, 122 R, 122 A, 1 R, 125 R, 125 A, 123 R, 123 A; 185/38

[56] References Cited

U.S. PATENT DOCUMENTS

| | | | |
|---|---|---|---|
| 1,223,807 | 4/1917 | Leavitt | 185/38 |
| 2,026,902 | 1/1937 | McClellan | 273/121 R |
| 2,134,185 | 10/1938 | Hansen | 273/121 |
| 3,348,841 | 10/1967 | Heiss | 273/125 A |
| 3,565,425 | 2/1971 | Breslow | 273/1 R |
| 3,961,794 | 6/1976 | Goldfarb et al. | 273/1 R |

FOREIGN PATENT DOCUMENTS

| | | | |
|---|---|---|---|
| 767753 | 5/1934 | France | 273/123 R |
| 833859 | 7/1938 | France | 273/123 A |

*Primary Examiner*—Richard C. Pinkham
*Assistant Examiner*—Lawrence E. Anderson
*Attorney, Agent, or Firm*—Staas & Halsey

[57] ABSTRACT

An amusement device having a playing surface provided with first openings and a path leading toward the openings, a plate positioned below the playing surface and provided with second openings, the plate being mounted to move between first and second positions wherein the first and second openings are aligned and non-aligned, respectively, the plate normally being biased toward the second position, a plurality of playing pieces capable of passing through the openings, a propulsion mechanism for propelling the playing pieces along the path toward the first openings, and a timing mechanism for automatically moving the plate to the first position after a predetermined interval of time such that those of the playing pieces that have been positioned in the first openings then drop through the second openings into the housing, after which the game begins anew.

3 Claims, 7 Drawing Figures

AMUSEMENT DEVICE WITH APERTURES AND TIMED BALL RELEASE

BACKGROUND AND SUMMARY OF THE INVENTION

The game of the present invention includes a plurality of small balls that are sequentially propelled towards a target which consists of a plurality of openings. The object of the game is to lodge as many of the balls as possible within the openings within a predetermined period of time. A timing mechanism releases each of the captured balls and transmits same back to the starting area after which the game begins anew.

DESCRIPTION OF THE PREFERRED EMBODIMENT

Figure 1:
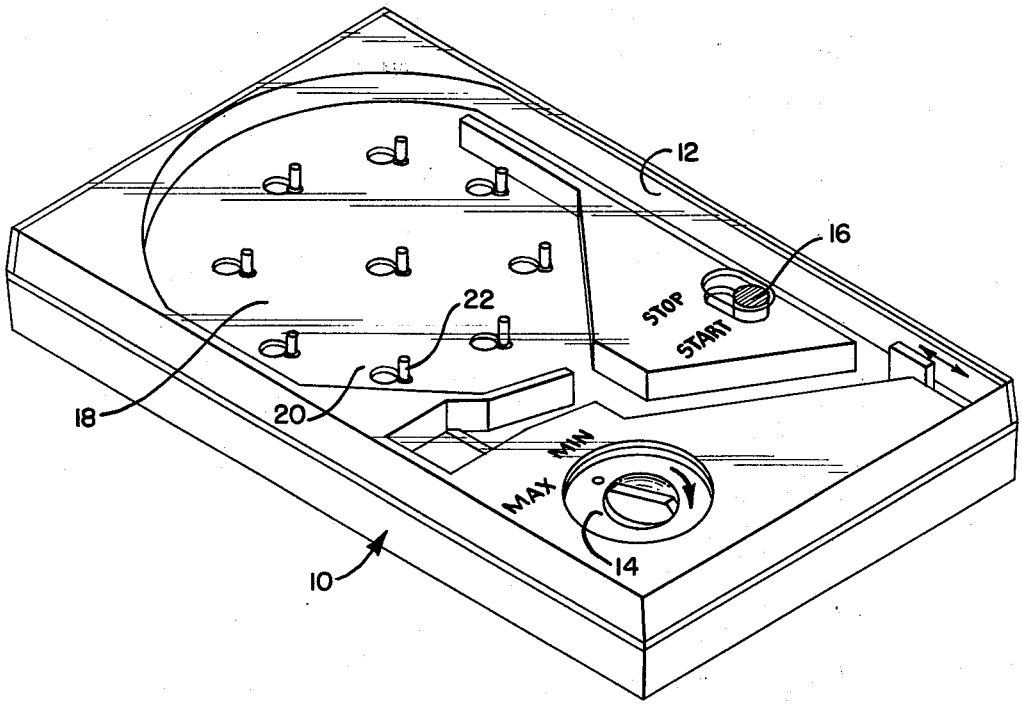
FIG. 1 is a perspective view of the amusement device of the present invention, illustrating in particular the target openings into which the playing pieces are designed to pass, the timing mechanism which at the end of its cycle causes the balls that have been successfully lodged in the openings of the target to be released, and the operating mechanism for stopping and starting the timing mechanism.
Figure 2:
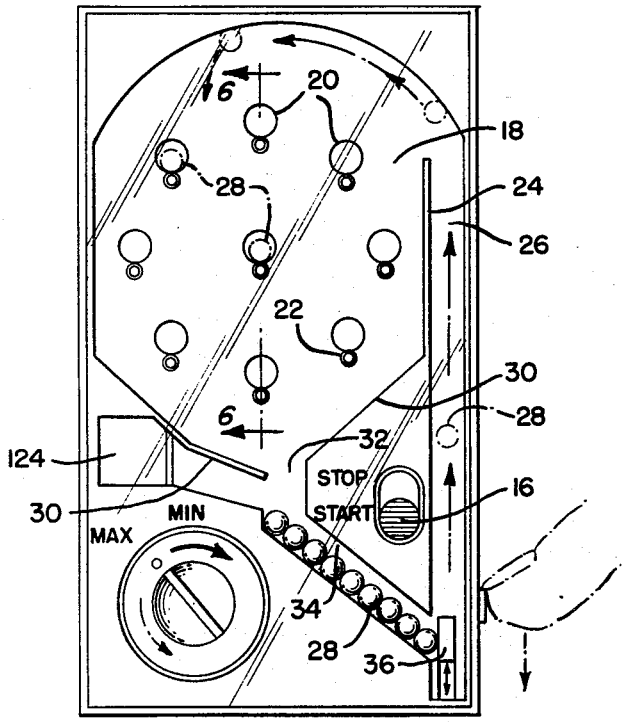
FIG. 2 is a top plan view of the amusement device illustrating in particular actuation of the mechanism for propelling the playing pieces upwardly along a path from whence they move downwardly either becoming lodged within the openings of the target area or missing the openings after which they return to the starting point.

As illustrated in FIG. 1, the amusement device of the present invention includes a housing 10 which includes across the top thereof a transparent cover 12 through which the timing mechanism or knob 14 and the actuating button 16 protrude. Below the transparent cover 12 lies the playing surface 18 which includes a plurality of openings 20 adjacent to which are positioned upstanding posts 22. The wall 24 defines a path 26 along which a plurality of playing pieces in the form of small balls 28 travel after being propelled into the playing surface 18 wherein the openings 20 are located. It will also be apparent from FIGS. 2 and 3 that the walls 30 define an open area 32 through which those of the playing pieces 28 that have not been lodged within the openings 20 may pass into the chute 34. Projecting upwardly through an opening provided in the playing surface 18 is a hammer mechanism 36 which is capable of being moved forwardly to contact the playing pieces 28 propelling same upwardly along the path 26 and eventually downwardly through the playing surface 18 to either pass into the openings 20 or in the advent of missing same to pass through the playing area 18 through the open area 32 into the chute 34.

Figure 4:
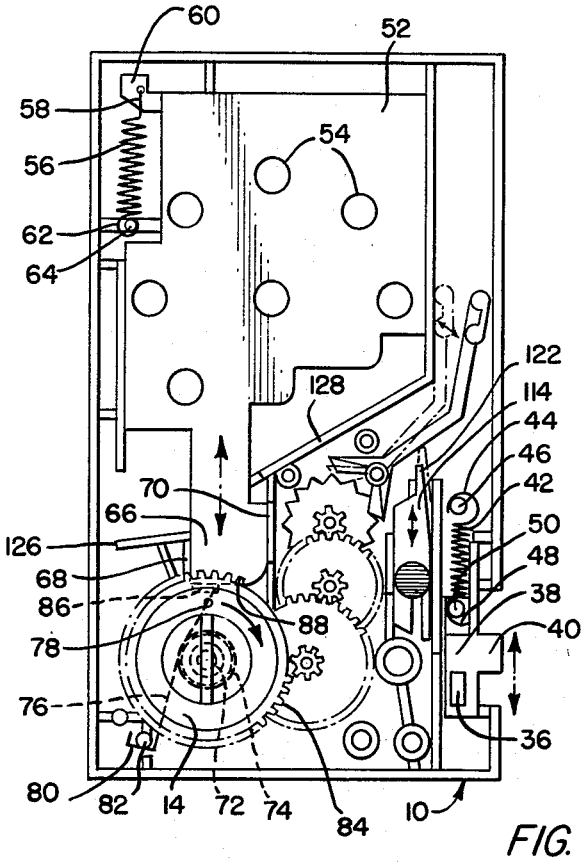
FIG. 4 is a top plan view of the amusement device of the present invention with the playing surface thereof removed so as to expose the internal working mechanisms, and in particular the position of the plate containing the second plurality of openings after it has been automatically moved by the timing mechanism bringing the sets of openings into alignment so as to permit the playing pieces that have been successfully deposited within the openings of the playing surface to pass downwardly into the housing to be returned to the starting area such that the game may begin anew.

Turning now to FIG. 4, it will be apparent that the hammer 36 is affixed to the block 38 which has at one side thereof a handle 40. The spring 42 has one end 44 thereof secured to the post 46 which is appropriately mounted to the housing 10 and the other end 48 thereof secured to the post 50 which is formed as an integral part of the block 38. Thus, by pulling backwardly on the handle 40 the block 38 is moved backwardly against the force of the spring 42, the subsequent release of the handle 40 causing the hammer 36 to move forwardly striking the playing piece 28 propelling same forwardly along the path 26.

As also seen in FIG. 4, the plate 52 is provided with a plurality of openings 54 which are arranged in a pattern similar to that of the openings 20 provided within the playing surface 18. The plate 52 is normally urged downwardly by the spring 56 which is attached at one end 58 to an arm 60 formed as a part of the plate 52 and at the other end 62 to a post 64 formed as an integral part of the casing 10. The plate 52 terminates at one end thereof in a leg 66 which is supported between the walls 68 and 70 formed as a part of the casing 10 thus permitting the plate 52 to reciprocate.

Figure 6:
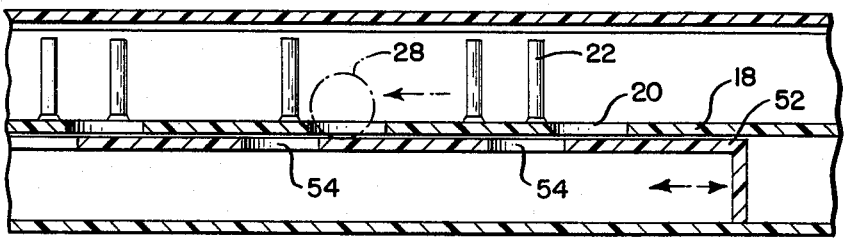
FIG. 6 is a sectional view taken along the line 6—6 of FIG. 2 illustrating the plate in its blocking position wherein the playing pieces are permitted to become lodged within the openings within the playing surface indicating the scoring of a goal.
Figure 7:
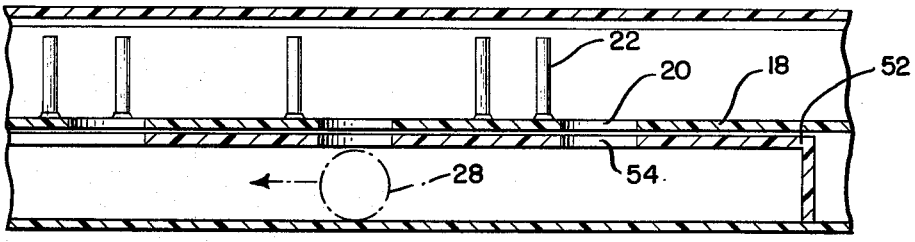
FIG. 7 is a sectional view taken along the line 7—7 of FIG. 3 indicating alignment of the openings of the playing surface and the plate at the end of the timing cycle at which time the playing pieces that have scored goals are permitted to pass downwardly into the housing to return to the starting point such that the game may begin anew.

Extending upwardly from the casing 10 is a post 72, shown in dotted lines in FIG. 4, about which the cylindrical portion 74, also shown in dotted lines in FIG. 4, of the timing mechanism 14 is mounted for rotation. Wound around the cylindrical portion 74 is a coiled spring 76 having one end 78 thereof mounted to the timing mechanism while the other end thereof 80 is appropriately fastened to an abutment 82 provided on the housing 10. The timing mechanism 14 is provided throughout most of its periphery with a continuous rack of teeth 84 and at one point thereof is provided with an abutment 86. From the foregoing, it will be apparent that the spring 56 normally urges the plate 52 downwardly to the position illustrated in FIG. 5 wherein the openings 54 of the plate 52 are not in alignment with the corresponding openings 20 within the playing surface 18. But as the timing mechanism 14 rotates to the point where the abutment 86 contacts the edge 88 of the leg 66 of the plate 52, the plate 52 is caused to move upwardly against the force of the spring 56 to the position illustrated in FIG. 4 wherein the openings 54 are precisely aligned with the openings 20. It will be apparent that when the openings 20 and 54 are aligned the playing pieces 28 may pass downwardly through these openings into the bottom of the housing 10, as illustrated in FIG. 7. Prior to the openings 20 and 54 being aligned, a playing piece 28 that has entered one of the openings 20 within the playing surface 18 remains in this opening resting against the blocking surface of the plate 52, as illustrated in FIG. 6. It will also be apparent that by rotating the timing mechanism 14 in a clockwise direction it is possible to wind the coil spring 76 around the cylindrical portion 74 of the timing mechanism 14, after which release of the timing mechanism 14 results in counterclockwise unwinding movement of same.

Figure 5:
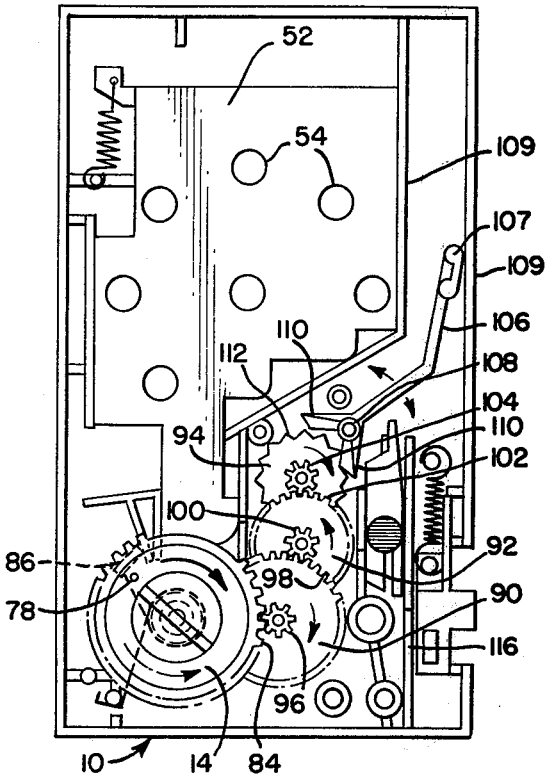
FIG. 5 is a top plan view of the amusement device with the playing surface removed illustrating the unwinding of the timing mechanism during which time the plate immediately below the playing surface blocks the opening in the playing surface permitting the playing pieces to be lodged within the openings.

From FIGS. 4–5, it will also be apparent that gear wheels 90, 92, and 94 are appropriately mounted to the housing 10 for rotation. The rack of teeth 84 of the timing mechanism 14 mesh with the teeth of a small gear 96 provided as an integral part of the larger gear 90. The gear 90 is provided with teeth 98 that mesh with the teeth of a small gear 100 provided as an integral part of the gear 92. The teeth 102 of the gear 92 mesh with the teeth of a smaller gear 104 formed as an integral part of the gear wheel 94. Thus, the counterclockwise unwinding rotation of the timing mechanism 14 causes the gear 90 to rotate clockwise which in turn causes the gear 92 to rotate counterclockwise which in turn causes the gear 94 to rotate clockwise, as illustrated in FIG. 5. In this connection it should be noted that the gear wheel 90 is provided with a shaft that is positioned within a slightly elongated slot formed in the casing 10 to relieve the pressure against the gear wheel 90 during un-winding.

The reference numeral 106 designates an arm that is mounted to the casing 10 for rotation about the shaft 108. The arm 106 is provided at one end thereof with two prongs 110 which are designated to fit within the exaggerated teeth 112 of the gear 94.

Slide mechanism 114 is mounted for movement between walls 116 formed as a part of the casing 10, and the button 16 extends upwardly therefrom through openings 118 provided within the playing surface 18 and 120 provided within the transparent cover 12, as illustrated in FIG. 1. The sliding mechanism 114 terminates forwardly in a flange 122 positioned to engage the arm 106. It will be apparent that when the button 16 is positioned in the "stop" position, i.e. upwardly as seen in FIG. 1, the tip of the flange 122 engages the arm 106 causing same to rotate counterclockwise about shaft 108 to the position shown in dotted lines in FIG. 4, at which time the prongs 110 become firmly fixed within the exaggerated teeth 112 of the gear wheel 94 precluding the gear wheel 94 from rotating, the result of which is to preclude the gear wheels 92 and 90 as well as the timing mechanism 14 from rotating. In similar manner, downward movement of the button 16 to the "start" position causes the sliding mechanism 114 to move downwardly such that the tip of the flange 122 no longer engages the rod 106 permitting the gear 94 to rotate in a clockwise direction, during which time there is a back and forth movement of the arm 106 caused by the exaggerated teeth 112 sequentially engaging the prongs 110 which causes the free end 107 of the arm to sequentially strike the walls 109 of the casing producing a clicking sound. But the gear 94 is free to rotate, the result of which is that the timing mechanism 14 slowly rotates under the influence of the coil spring 76 until the abutment 78 engages the edge 88 of the arm 66 of the plate 52 at which time the plate 52 is moved upwardly against the force of the spring 56 until the openings 54 within the plate 52 are aligned within the openings 20 within the playing surface 18.

Figure 3:
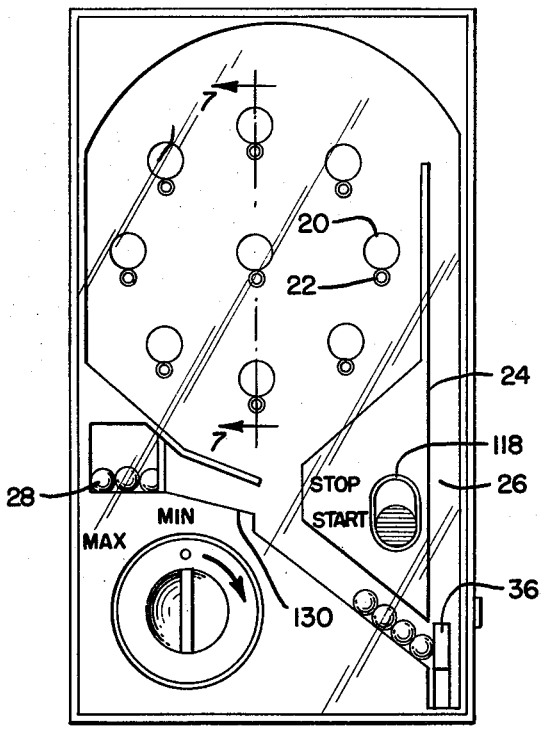
FIG. 3 is a top plan view of the amusement device illustrating release of the playing pieces that have been successfully propelled into the openings of the target after the time allotted for play has elapsed.

Returning to FIG. 2, it will be apparent that there is defined within the playing surface 18 an opening 124 which is in communication with that portion of the casing 10 located there below which, as illustrated in FIG. 4, is provided with a wall 126. Thus, as the plate 54 is moved to its upward position, as illustrated in FIG. 4, wherein the openings 54 contained therein coincide with the openings 20 of the playing surface 18, and the playing pieces 28 pass downwardly through the aforementioned openings into the bottom of the casing 10, the playing pieces 28 roll downwardly with the assistance of the guide 128 and the wall 126 into the general vicinity of the opening 124 provided within the playing area 18, as illustrated in FIG. 3. Thereafter, it is possible by shaking the casing 10 to make the playing pieces 28 roll down the inclined wall 130 into the chute 34 so that the game can begin anew.

I claim:

1. An amusement device, comprising a housing provided with a playing surface having first openings and a path leading toward said openings, a plate below said playing surface provided with second openings and mounted to move between first and second positions wherein said first and second openings are aligned and non-aligned, respectively, means biasing said plate toward said second position, a plurality of playing pieces each capable of passing through said openings, means for propelling said playing pieces along said path toward said first openings, and means automatically moving said plate to said first position after an interval of time, wherein said means automatically moving said plate comprises a knob mounted to said housing for rotation, said knob being provided with abutment means, and spring means for rotating said knob in one direction after said knob has been rotated manually in the opposite direction until said abutment means engages said plate urging said plate to its said first position.

2. An amusement device as in claim 1, further comprising teeth formed along at least part of the periphery of said knob starting from the vicinity of said abutment means, gear means mounted within said casing and provided with teeth, said gear means operatively engaging said teeth of said knob, and an arm mounted to pivot within said casing between two positions, said arm having prongs that tightly engage said teeth of said gear means when said arm is in one of said positions preventing said gear means from rotating, and means positioning said arm in said one position.

3. An amusement device, comprising:

a housing;

a playing surface provided with a plurality of first openings, and means defining a path toward said first openings;

a plate provided with a plurality of second openings corresponding to said first openings;

means mounting said plate within said casing below said playing surface for movement between first and second positions wherein said pluralities of said first and second openings are aligned and non-aligned, respectively, and spring means normally biasing said plate toward said second position;

a plurality of playing pieces capable of passing through said openings;

a knob having teeth along the periphery thereof, means mounting said knob to said casing for rotation, a coil spring wound around said knob and having one end secured to said knob and the other end to said housing to urge said knob to rotate in one direction, said knob being provided with an abutment positioned so as to engage said plate and move same to its said first position during the rotation of said knob;

arm means mounted to said casing to pivot between first and second positions, said arm means provided with prong means, and manually operable means for placing said arm means in its said first position; and gear train means operatively connected at one end thereof to said teeth of said knob and at the other end to said prong means of said arm means, said prong means cooperating at said other end of said gear train means to prevent movement of said gear train means when said arm is in said first position, while permitting movement of said gear train means when in said second position.

* * * * *